US010257624B2

(12) United States Patent
Rabel et al.

(10) Patent No.: US 10,257,624 B2
(45) Date of Patent: Apr. 9, 2019

(54) HEARING AID WIRELESS ANTENNA MOLDED INTO THE DEVICE SHELL

(71) Applicant: Starkey Laboratories, Inc., Eden Prairie, MN (US)

(72) Inventors: Jay Rabel, Shorewood, MN (US); Thomas Spaulding, Eden Prairie, MN (US); Thomas Blaise Bergner, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/827,837

(22) Filed: Aug. 17, 2015

(65) Prior Publication Data

US 2017/0055088 A1 Feb. 23, 2017

(51) Int. Cl.
*H04R 25/00* (2006.01)

(52) U.S. Cl.
CPC ..... *H04R 25/554* (2013.01); *H04R 25/608* (2013.01); *H04R 25/658* (2013.01); *H04R 2225/51* (2013.01)

(58) Field of Classification Search
CPC .. H04R 25/658; H04R 2225/51; H04R 25/65; H04R 25/652; H04R 2225/023; H04R 2225/025
USPC ..... 381/312, 322, 324, 323, 328
See application file for complete search history.

(56) References Cited

U.S. PATENT DOCUMENTS 6,031,923 A * 2/2000 Gnecco ..... H04R 25/60 174/350
6,546,109 B1 * 4/2003 Gnecco ..... H04R 25/652 174/353
6,549,633 B1 * 4/2003 Westermann ..... H04R 25/453 381/312
7,174,028 B1 * 2/2007 Niccolai ..... H04R 25/65 381/322
7,646,356 B2 * 1/2010 Adel ..... H01Q 1/273 343/767
7,742,614 B2 * 6/2010 Christensen ..... H01Q 1/273 320/108
8,224,006 B2 * 7/2012 Beck ..... H04R 25/608 29/594
8,565,457 B2 10/2013 Polinske et al.
2005/0099341 A1 5/2005 Zhang et al.
(Continued)

FOREIGN PATENT DOCUMENTS

EP 2688314 A2 1/2014
EP 2897385 A1 7/2015
(Continued)

OTHER PUBLICATIONS

"European Application Serial No. 16184576.3, Extended European Search Report dated Jan. 23, 2017", 6 pgs.

*Primary Examiner* — Phylesha Dabney
(74) *Attorney, Agent, or Firm* — Schwegman Lundberg & Woessner, P.A.

(57) ABSTRACT

A hearing aid is described which incorporates an antenna integrated into the housing or shell. The hearing aid shell may constructed by forming an inner shell portion, disposing an antenna on an outer surface of the inner shell portion, and forming an outer shell portion around the inner shell portion. In various embodiments, the hearing aid shell may be constructed using an injection molding process or a 3D printing process.

12 Claims, 2 Drawing Sheets

(56) References Cited

U.S. PATENT DOCUMENTS

| | | | | |
|---|---|---|---|---|
| 2005/0244024 | A1* | 11/2005 | Fischer | H04R 25/554 381/331 |
| 2007/0086610 | A1* | 4/2007 | Niederdrank | H01Q 1/273 381/312 |
| 2008/0272980 | A1* | 11/2008 | Adel | H01Q 1/273 343/895 |
| 2011/0182451 | A1* | 7/2011 | Vaarbroe | H04R 25/608 381/322 |

FOREIGN PATENT DOCUMENTS

| | | | | |
|---|---|---|---|---|
| EP | 3133839 | * | 8/2016 | H04R 25/554 |
| WO | WO-2005081538 | A1 | 9/2005 | |

* cited by examiner

Prior Art

HEARING AID WIRELESS ANTENNA MOLDED INTO THE DEVICE SHELL

FIELD OF THE INVENTION

This invention pertains to electronic hearing aids, hearing aid systems, and methods for their use.

BACKGROUND

Hearing aids are electronic instruments that compensate for hearing losses by amplifying sound. The electronic components of a hearing aid may include a microphone for receiving ambient sound, processing circuitry for amplifying the microphone signal in a manner that depends upon the frequency and amplitude of the microphone signal, a speaker for converting the amplified microphone signal to sound for the wearer, and a battery for powering the components. Hearing aids may also incorporate wireless transceivers for enabling communication with an external device and/or communication between two hearing aids worn by a user.

DETAILED DESCRIPTION

Figure 1:
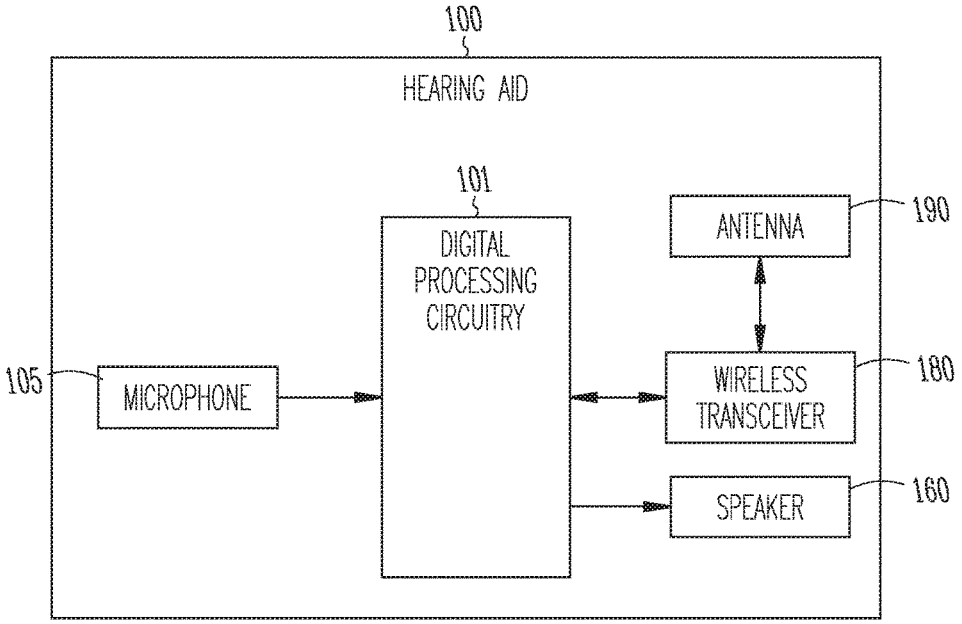
FIG. 1 shows the basic electronic components of an example hearing aid.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Hearing aids may incorporate wireless transceivers that enable communication communications between the two hearing aids typically worn by a user as well as communications between a hearing aid and an external device such as an external programmer or an audio streaming source such as a smartphone. In the case of ear-to-ear communication, the link between the hearing aids may be implemented as a near-field magnetic induction (NFMI) link operated in a frequency band between 3 and 15 MHz which easily propagates through and around the human head. The frequency band used for NFMI links, however, has a very limited propagation range. Therefore, in the case of communications between a hearing aid and an external device, far-field RF (radio-frequency) links using higher frequency bands such as the 900 MHz or 2.4 GHz ISM (Industrial Scientific Medical) bands are preferred.

Wireless transceivers need an antenna for radio transmission and reception which requires the hearing aid to incorporate one or more antennas. The frequencies at which the antenna is to operate impose certain size requirements for the hearing aid, especially if the antenna is to be contained within the device housing or shell. Antennas require a great deal of space within a small hearing aid. For reasons relating to both comfort and appearance, however, hearing aid users generally desire smaller hearing aids.

Described herein is a hearing aid and method for its construction in which the antenna for a wireless transceiver is embedded within the wall of the device shell or housing. In one embodiment, the hearing aid shell is constructed by a two-shot molding process where an inner shell portion is first molded, the antenna is disposed on the outside of the shell inner portion, and an outer shell portion is then molded around the inner shell portion leaving the antenna embedded within a wall of the completed shell. Such a molded-in antenna utilizing a two-shot molding process eliminates the need for a separate antenna part that is contained within the shell and enables devices to be designed smaller without the need for antenna space. A metal antenna (e.g., made of copper) molded into the shell wall also provides extra structural support for the shell. Constructing a hearing aid shell in this manner also enables specific and repeatable placement of the antenna in the device to produce a consistent response without the need for alignment features.

FIG. 1 illustrates the basic functional components of an example hearing assistance system that includes hearing aid 100. The system may include another similar hearing aid for bilateral wearing by a user. The components of the hearing aid are contained within a housing or shell that may be placed, for example, in the external ear canal or behind the ear. As explained below, depending upon the type of hearing aid, some of the components may be contained in separate housings. A microphone 105 receives sound waves from the environment and converts the sound into an input signal. The input signal is then amplified by pre-amplifier and sampled and digitized by an A/D converter to result in a digitized input signal. The device's digital signal processing (DSP) circuitry 101 processes the digitized input signal into an output signal in a manner that compensates for the patient's hearing deficit. The digital processing circuitry 101 may be implemented in a variety of different ways, such as with an integrated digital signal processor or with a mixture of discrete analog and digital components that include a processor executing programmed instructions contained in a processor-readable storage medium. The output signal is then passed to an audio output stage that drives speaker 160 (also referred to as a receiver) to convert the output signal into an audio output. A wireless transceiver 180 is interfaced to the hearing aid's DSP circuitry and connected to the feedpoint of an antenna 190 for transmitting and/or receiving radio signals. The wireless transceiver 180 may enable ear-to-ear communications between the two hearing aids as well as communications with an external device. When receiving an audio signal from an external source, the wireless receiver 180 may produce a second input signal for the DSP circuitry that may be combined with the input signal produced by the microphone 105 or used in place thereof.

In certain types of hearing aids, the electronic components are enclosed by a housing or shell that is designed to be worn in the ear for both aesthetic and functional reasons. Such devices may be referred to as in-the-ear (ITE), in-the-canal (ITC), completely-in-the-canal (CIC), or invisible-in-the-canal (IIC) hearing aids. Another type of hearing aid, referred to as a behind-the-ear (BTE) hearing aid, utilizes a housing that is worn behind the ear that contains all of the components shown in FIG. 1 including the receiver (i.e., the speaker) that conducts sound to an earbud inside the ear via an audio tube. Another type, referred to as a receiver-in-canal (RIC) hearing aid, also has a housing worn behind the ear that contains all of the components shown in FIG. 1 except for the receiver, with the output state then being electrically connected to the receiver worn in the ear canal. The shell or housing of any of these types of hearing aids may be constructed with an antenna embedded into the shell wall as described herein.

Figure 2:
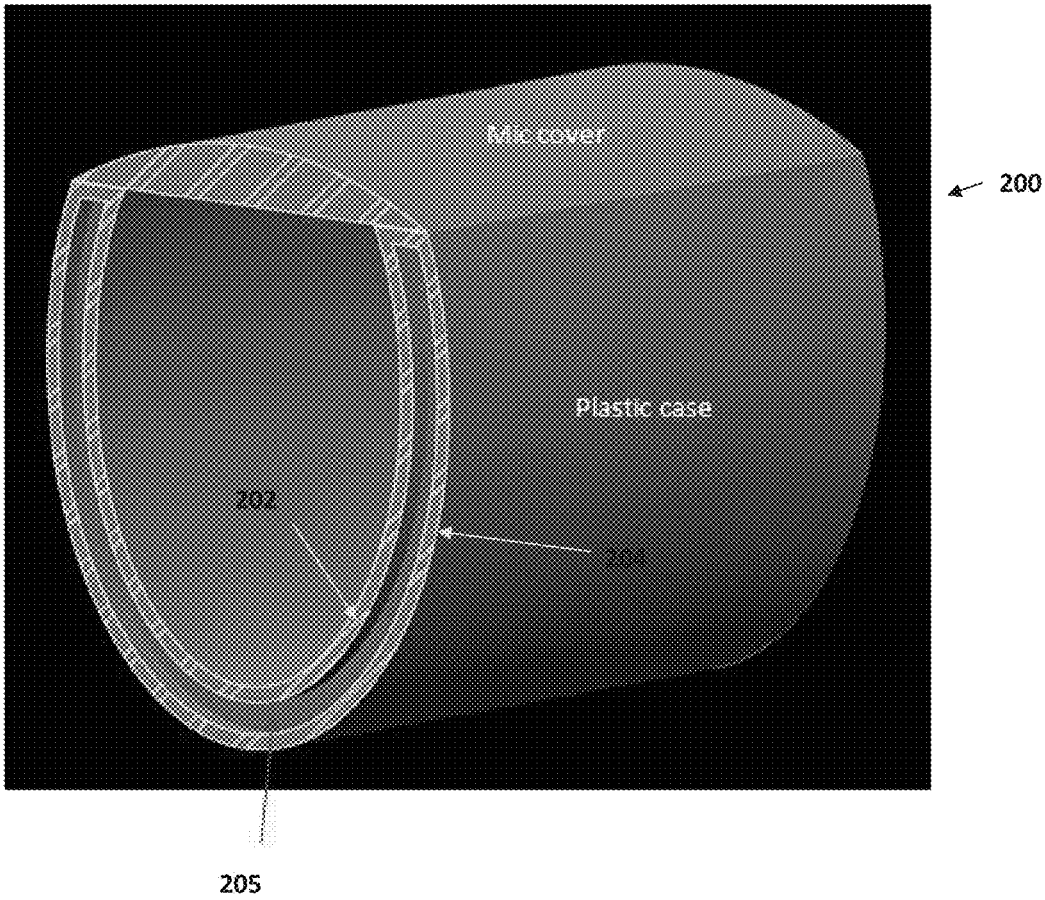
FIG. 2 illustrates a hearing aid shell with an embedded antenna.

FIG. 2 shows an example of a hearing aid shell having an antenna embedded into the shell wall. The hearing aid shell 200 may be made of plastic and is made up of an inner shell portion 202 and an outer shell portion 204. An antenna 205, which may be made of copper, is disposed between the inner shell portion 202 and the outer shell portion 204. In one embodiment, the shell 200 is constructed using a two-shot molding process. The inner shell portion 202 is first injection molded. The copper (or other conductive material) antenna 205 is then wrapped or otherwise disposed around the inner shell portion 202 and placed into a second mold. The second molding process then encases the antenna 205 between the inner shell portion 202 and the second shot material, the latter forming the outer shell portion 204. The two stage molding process may utilize the same material or dissimilar materials for the inner shell portion 202 and the outer shell portion 204. For example, an elastomeric polymer may be used for either or both shell portions 202 and 204 which may aid in hermetically sealing the device internal components. In either case the two shot molding process allows for a chemical bond between the materials used in both shots. The two-shot molding process also allows an easier way to effectively expose an electrical connection from the antenna 205 in order to provide a feedpoint for connection to the wireless transceiver 180 shown in FIG. 1 by allowing for an easier molding shutoff against the mold and the antenna copper.

In another embodiment, a hearing aid shell with an embedded antenna as illustrated in FIG. 2 may be constructed using a three-dimensional (3D) printing process. In 3D printing, additive processes are used to construct an object by laying down successive layers of material under computer control. The hearing aid shell in FIG. 2 may be constructed by first layering the inner shell portion 202, wrapping or otherwise disposing the antenna 205 on the portion 202, and then layering the outer shell portion. In another embodiment, the antenna 205 is also layered on the inner shell portion 202 by the 3D printing process.

Example Embodiments

In one embodiment, a hearing aid comprises: a hearing aid shell, wherein the hearing aid shell contains components that include a microphone for converting an audio input into an input signal, a digital processing circuitry for processing the input signal, an output state to produce an output signal in a manner that compensates for the patient's hearing deficit, and a wireless transceiver connected to the digital processing circuitry; an antenna having a feedpoint connected to the wireless transceiver; and wherein the hearing aid shell is constructed by forming an inner shell portion, disposing an antenna on an outer surface of the inner shell portion, and forming an outer shell portion around the inner shell portion. The antenna may be made of copper.

In one embodiment, the hearing aid shell is constructed by a two-shot injection molding process in which the inner shell portion is first molded, the antenna is disposed on the outside of the inner shell portion, and the outer shell portion is then molded around the inner shell portion leaving the antenna embedded within a wall of the completed hearing aid shell. The antenna may be wrapped around the inner shell portion. The inner shell portion and the outer shell portion may be made of plastic or made of dissimilar elastomeric materials that chemically bond to one another.

In one embodiment, the hearing aid shell is constructed by a three-dimensional (3D) printing process. The hearing aid shell may constructed by layering the inner shell portion, wrapping or otherwise disposing the antenna on the inner shell portion, and then layering the outer shell portion. Alternatively, the hearing aid shell may be constructed by layering the inner shell portion, layering the antenna on the inner shell portion, and then layering the outer shell portion.

Hearing assistance devices typically include at least one enclosure or housing or shell, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations. In one embodiment, a method for constructing a hearing aid comprises constructing a hearing aid shell as described herein.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

a hearing aid shell, wherein the hearing aid shell contains components that include a microphone for converting an audio input into an input signal, a digital processing circuitry for processing the input signal, an output stage to produce an output signal in a manner that compensates for the patient's hearing deficit, and a wireless transceiver connected to the digital processing circuitry;

an antenna having a feedpoint connected to the wireless transceiver, wherein the antenna is embedded in a wall of the hearing aid shell;

wherein the hearing aid shell is constructed by a two-shot molding process where an inner shell portion is first molded, the antenna is disposed on the outside of the shell inner portion, and an outer shell portion is then molded around the inner shell portion leaving the antenna embedded within a wall of the completed hearing aid shell, wherein an electrical connection from the antenna is exposed during the two-shot molding process to provide the feedpoint for the wireless transceiver; and, wherein, in at least one cross-section of the hearing aid shell, the antenna is disposed in the shell wall between the outer shell portion and inner shell portion throughout the cross-section to provide additional structural support.

2. The hearing aid of claim 1 wherein the antenna is wrapped around the inner shell portion.

3. The hearing aid of claim 1 wherein the inner shell portion and the outer shell portion are made of plastic.

4. The hearing aid of claim 1 wherein the inner shell portion and the outer shell portion are made of dissimilar elastomeric materials that chemically bond to one another.

5. The hearing aid of claim 1 wherein the antenna is made of copper.

6. A method for constructing a hearing aid, comprising:

constructing a hearing aid shell with a two-shot molding process by:

molding an inner shell portion;

disposing an antenna on the outside of the shell inner portion;

molding an outer shell portion around the inner shell portion leaving the antenna embedded within a wall of the completed hearing aid shell;

exposing an electrical connection from the antenna to provide a feedpoint for the wireless transceiver during the two-shot molding process; and, disposing the antenna such that, in at least one cross-section of the hearing aid shell, the antenna is disposed in the shell wall between the outer shell portion and inner shell portion throughout the cross-section to provide additional structural support.

7. The method of claim 6 further comprising wrapping the antenna around the inner shell portion.

8. The method of claim 6 wherein the inner shell portion and the outer shell portion are made of plastic.

9. The method of claim 6 wherein the inner shell portion and the outer shell portion are made of dissimilar elastomeric materials that chemically bond to one another.

10. The method of 6 wherein the antenna is made of copper.

11. The method of claim 6 further comprising disposing within the hearing aid shell a microphone for converting an audio input into an input signal, a digital processing circuitry for processing the input signal, an output stage to produce an output signal in a manner that compensates for the patient's hearing deficit, and a wireless transceiver connected to the digital processing circuitry.

12. The method of claim 11 further comprising exposing an electrical connection from the antenna in order to provide a feedpoint for connection to the wireless transceiver.

* * * * *